US007841093B1

(12) United States Patent
Brady et al.

(10) Patent No.: US 7,841,093 B1
(45) Date of Patent: Nov. 30, 2010

(54) HOUSEHOLD KITCHEN OPENING APPLIANCE

(75) Inventors: Martin Brady, Chesterfield, VA (US); Anthony V. Cruz, Thousand Oaks, CA (US)

(73) Assignee: Hamilton Beach Brands, Inc., Glen Allen, VA (US)

( * ) Notice: Subject to any disclaimer, the term of this patent is extended or adjusted under 35 U.S.C. 154(b) by 782 days.

(21) Appl. No.: 09/228,109

(22) Filed: Jan. 11, 1999

(51) Int. Cl.
*B67B 7/00* (2006.01)

(52) U.S. Cl. ..... 30/408; 30/298.4

(58) Field of Classification Search ..... 30/408, 30/298.4, 151, 155, 131; 7/113; D8/18, D8/19, 33–43; D19/21–23, 77, 78, 73; 312/352; 206/349, 5, 371; 248/37.3, 37.6; 211/70.6, 211/70.7, 60.1

See application file for complete search history.

(56) References Cited

U.S. PATENT DOCUMENTS 2,027,785 A * 1/1936 Rauh ..... 30/131 X
2,187,386 A * 1/1940 Strocco et. al. ..... 225/73
2,720,189 A * 10/1955 Newman ..... 312/352
2,786,269 A * 3/1957 Stroyvonss ..... 30/436
3,307,255 A * 3/1967 Hubrich
3,585,717 A * 6/1971 Bielak et al.
3,730,391 A * 5/1973 O'Bannon ..... 30/400 X
3,776,387 A * 12/1973 Brent
3,950,801 A * 4/1976 Morrison ..... D8/33
4,152,831 A * 5/1979 Davies
4,334,332 A * 6/1982 Downs ..... 7/150
4,348,809 A * 9/1982 Jackson ..... 30/138
4,463,848 A * 8/1984 Parker ..... 206/371
4,495,696 A * 1/1985 Fethke et al. ..... 30/138
4,561,182 A 12/1985 Yamamoto et al.
4,561,548 A * 12/1985 Call ..... 211/70.7
4,805,818 A * 2/1989 Harrison ..... 30/143
4,860,455 A 8/1989 Conneally
4,979,308 A 12/1990 Moore
4,984,368 A * 1/1991 Hoover et al. ..... 30/151 X
5,005,710 A * 4/1991 Hofer
5,109,978 A * 5/1992 Cawley ..... 206/390
5,244,220 A * 9/1993 Cortez ..... 248/127
5,301,433 A * 4/1994 Rogers ..... 30/423
5,307,717 A * 5/1994 Winston ..... 30/124
5,421,092 A 6/1995 Guilmette et al.
5,484,066 A * 1/1996 Luisi ..... 211/69.8
5,494,176 A * 2/1996 Zallo ..... 211/70.7
5,630,517 A * 5/1997 Maznik
5,676,440 A 10/1997 Garber et al.

(Continued)

FOREIGN PATENT DOCUMENTS

EP 606774 A2 * 7/1994

OTHER PUBLICATIONS

Crate&Barrel "Best Buys 2005", p. 86.*

(Continued)

*Primary Examiner*—Jason Daniel Prone
(74) *Attorney, Agent, or Firm*—Alexander D. Raring

(57) ABSTRACT

An under-the-cabinet household opening appliance including an electric can opener, a jar opener mounted on the bottom wall of the can opener housing, and a sheath for a scissors on the back of the housing. A scissors holder in the sheath releasably retains a scissors within the sheath. A bottle opener and a hone are also mounted on the appliance housing.

6 Claims, 4 Drawing Sheets

U.S. PATENT DOCUMENTS

| | | | | | |
|---|---|---|---|---|---|
| D387,641 | S | | 12/1997 | Naft et al. | |
| 5,775,518 | A | * | 7/1998 | Connor | 211/70.7 |
| 5,791,608 | A | * | 8/1998 | Nielsen et al. | |
| 5,819,932 | A | * | 10/1998 | Norbits | |
| D406,738 | S | * | 3/1999 | Brady | D8/36 |
| D406,994 | S | * | 3/1999 | Brady | D8/36 |
| 5,880,713 | A | * | 3/1999 | Belardinelli | 211/60.1 |
| D415,890 | S | * | 11/1999 | Eriksson et al. | D3/220 |
| D417,129 | S | * | 11/1999 | Brady et al. | D8/35 |
| 6,082,253 | A | * | 7/2000 | Ridler | |
| 6,098,293 | A | * | 8/2000 | Bronner | 30/405 |
| 6,253,662 | B1 | * | 7/2001 | Zelson | 99/279 |
| 6,279,236 | B1 | * | 8/2001 | Brady et al. | 30/410 |
| 6,374,443 | B1 | * | 4/2002 | Ancona et al. | 7/110 |
| 6,470,521 | B1 | * | 10/2002 | Ancona et al. | 7/110 |
| 6,805,246 | B1 | * | 10/2004 | Manabat | 211/70.7 |
| 6,832,543 | B2 | * | 12/2004 | Siano et al. | 99/340 |
| 7,249,683 | B2 | * | 7/2007 | Smith et al. | 211/70.7 |
| 2002/0148746 | A1 | * | 10/2002 | Eriksson et al. | 206/349 |
| 2003/0159293 | A1 | * | 8/2003 | DiPalma | 30/151 |
| 2005/0204566 | A1 | * | 9/2005 | Loporcaro | 30/151 |
| 2007/0234485 | A1 | * | 10/2007 | Peterson et al. | 30/123 |
| 2008/0235953 | A1 | * | 10/2008 | Wang | 30/151 |

OTHER PUBLICATIONS

Front and back cover and pp. 12 and 28 of the 93/94 "Hamilton Beach/Proctor-Silex Catalog" published Apr. 1993 by Hamilton Beach/Proctor-Silex, Inc.

Use and care manual for-Black and Decker Model ECL80 Can opener, published by Black & Decker, Inc. 1985.

Product Catalog, front and rear cover and p. 6, published by Hamilton Beach/Proctor-Silex, Inc. 1992.

Instruction manual for Presto "Above All" can opener published by National Presto Industries, Inc. 1989.

Front and rear cover and unmarked p. 14 from the "Hot News from Proctor-Silex 1987" catalog published by WearEver-ProctorSilex, Inc., 1987.

See Information Disclosure statement regarding offer for sale less than one year prior to filing date.

* cited by examiner

HOUSEHOLD KITCHEN OPENING APPLIANCE

FIELD OF THE INVENTION

This invention relates to a household kitchen opening appliance, particularly for opening cans, jars, bottles or bags.

INCORPORATION BY REFERENCE

The disclosure of U.S. Pat. No. 5,676,440, is hereby incorporated by reference herein.

BACKGROUND OF THE INVENTION

Kitchen can openers often are provided with auxiliary features useful for opening products other than cans. For example, can openers are known which have bottle openers for removing bottle caps, bag slitters for opening bags, and hones for sharpening knives or scissors. Many households have various separate kitchen tools, such as jar openers, especially for opening wide-mouth jars, can openers, and bottle openers. In addition, many households have kitchen scissors for opening bags or for cutting food items, such as whole fryer chickens, into smaller portions. These tools are often haphazardly kept in cabinet drawers along with other tools and various other items and can be a nuisance to retrieve when needed.

SUMMARY OF THE INVENTION

An object of this invention is to provide an opening center by which a single appliance provides multiple opening functions commonly needed in a kitchen using various different tools.

Another object of this invention is to provide an opening center which is conveniently available and can be permanently installed in a single location in a kitchen. More specifically, an object of this invention is to provide a kitchen opening center which can be mounted under a kitchen cabinet with its several tools conveniently accessible and useable.

In accordance with this invention, an under-the-cabinet household kitchen opening appliance is provided that comprises an electrically operated can opener, a manually-operated jar opener mounted under a kitchen cabinet, and a sheath for a scissors in addition to other features such as a bottle opener and a hone.

An under-the-cabinet household opening appliance in accordance with this invention includes an electric can opener, a jar opener mounted on the bottom wall of the can opener housing, and a sheath for a scissors on the back of the housing. A scissors holder in the sheath releasably retains a scissors within the sheath. The appliance preferably also includes a bottle opener and a hone.

Other objects and advantages will become apparent from the following description and the drawings.

DETAILED DESCRIPTION

Figure 1:
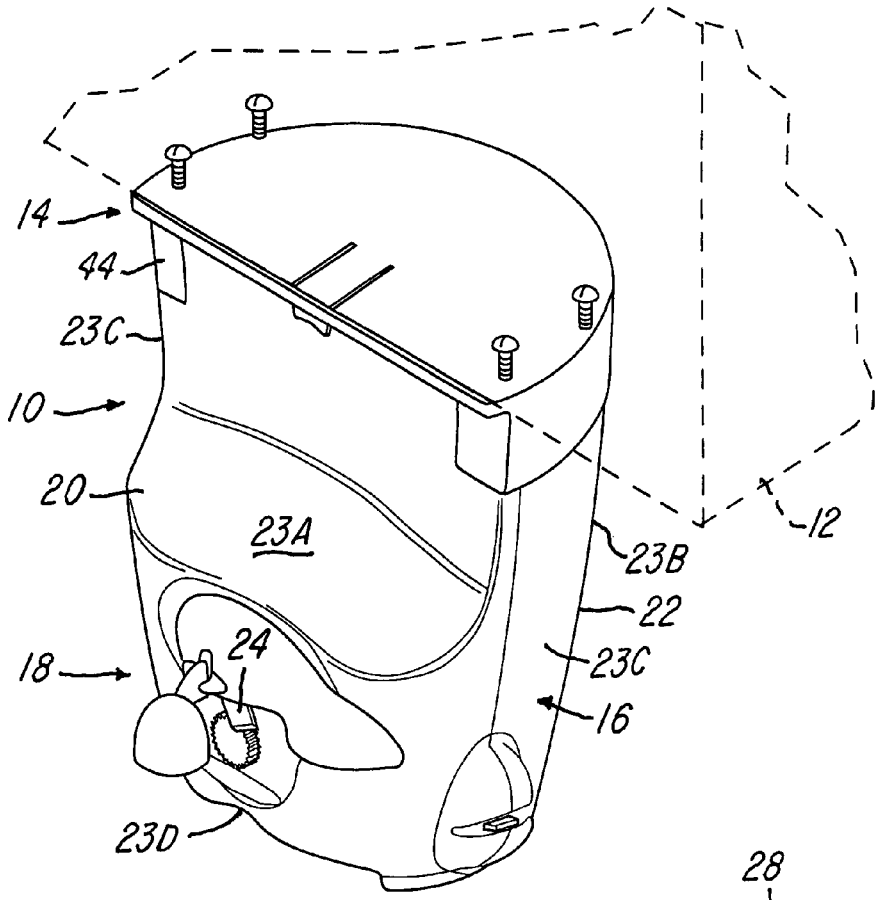
FIG. 1 is a front, top and right side perspective view of a household kitchen opening appliance in accordance with this invention, the appliance being shown assembled on a mounting bracket assembly.
Figure 2:
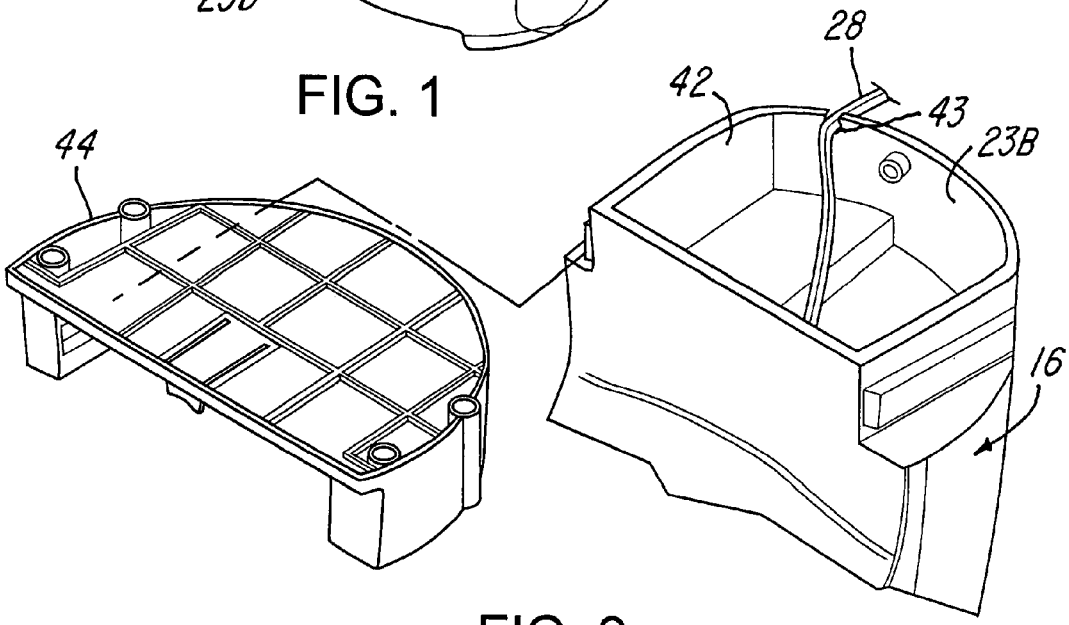
FIG. 2 is a fragmentary, exploded front, top and left side perspective view of the opening appliance and a mounting bracket forming part of the mounting assembly.

Referring to FIGS. 1 and 2, a household kitchen opening appliance, generally designated 10, in accordance with this invention is shown mounted to the underneath side of a kitchen cabinet 12 by a mounting arrangement, generally designated 14 including a mounting bracket assembly 44. The precise mounting arrangement 14 and the bracket assembly 44 are unimportant for purposes of this invention. These may be essentially the same as the mounting arrangement 14 and the bracket assembly 44 shown and described in the aforementioned U.S. Pat. No. 5,676,440. Therefore, these parts are not further disclosed herein. Appliance 10 comprises a generally rectangular housing 16 carrying a can opener assembly, generally designated 18. Housing 16 comprises a front portion 20 and a rear portion 22, preferably made of a plastic material, such as ABS, which is presently preferred, polypropylene or polystyrene or other suitable material, mated together to partially enclose and carry the can opener assembly 18, Front portion 20 and rear portion 22 of housing 16 cooperate to define a front wall 23A, a rear wall 23B, two side walls 23C, and a bottom wall 23D.

Can opener assembly 18 preferably includes an automatic knife mechanism, generally designated 24, which may be identical to the knife mechanism illustrated in the aforementioned U.S. Pat. No. 5,676,440.

With reference to FIG. 2, the upper part of the housing 16 is provided with a cavity 42 for storing a power cord 28 and its plug (not shown) when appliance 10 is not mounted under-the-cabinet. A notch 43 is provided in the rear wall 23B of the housing 16 through which the power cord 28 extends when the appliance 10 is mounted under a cabinet. (The cord 28 is omitted in FIG. 3.)

Figure 4:
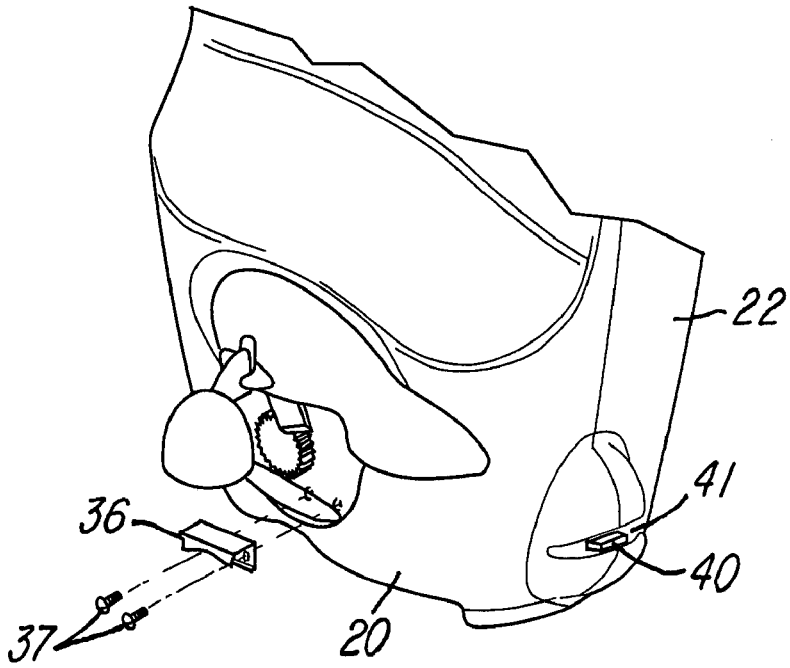
FIG. 4 is a fragmentary perspective view of the lower front and left side portion of the housing of the opening appliance of this invention showing a bottle opener exploded away from the housing.
Figure 5:
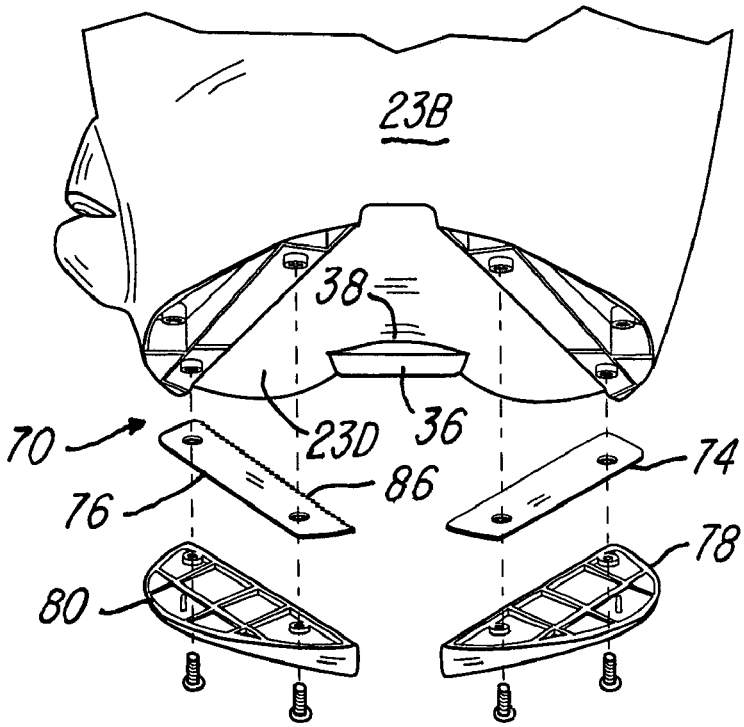
FIG. 5 is a fragmentary perspective view of the back and bottom of the housing of the opening appliance of this invention showing a jar opener exploded away from the housing.
Figure 6:
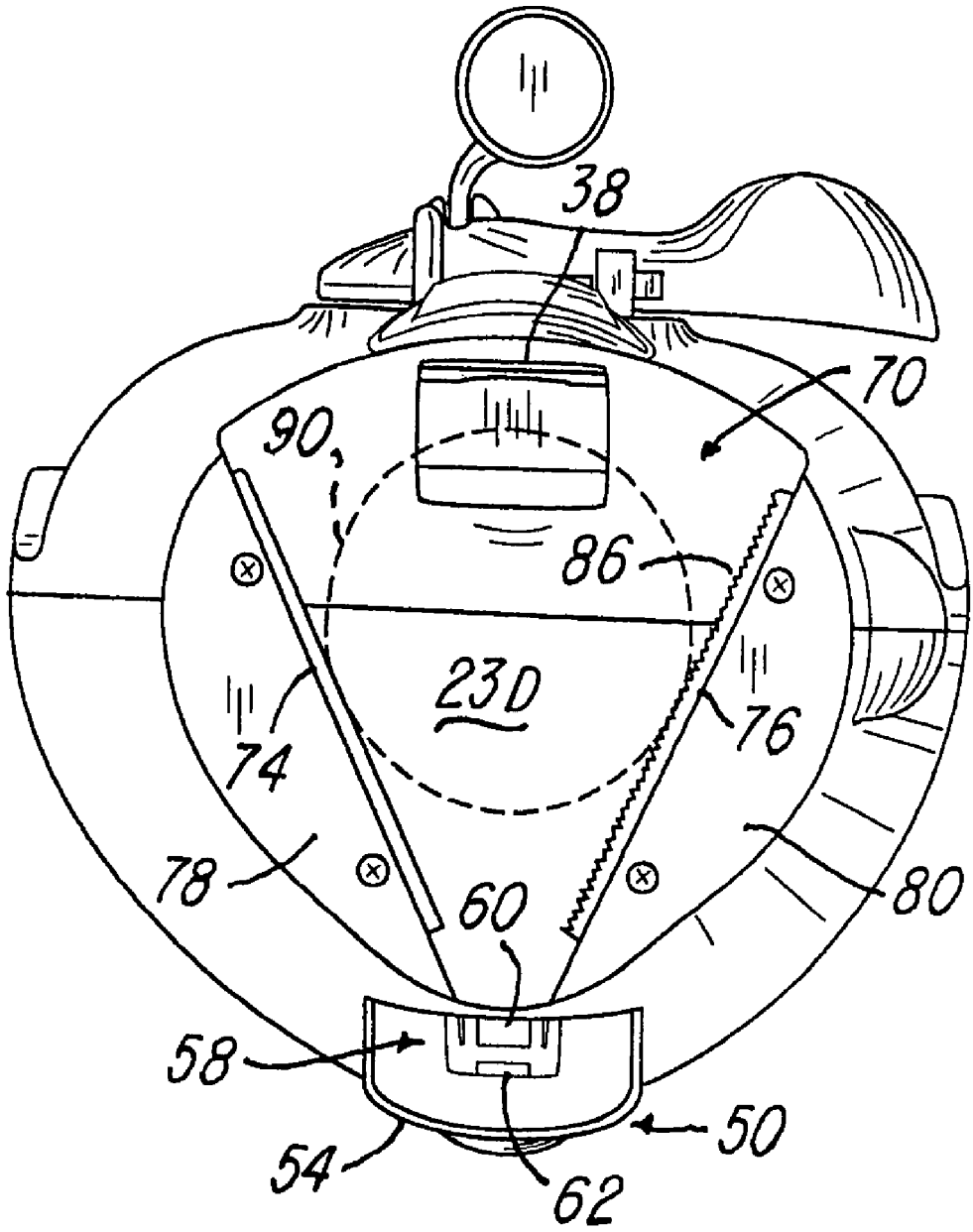
FIG. 6 is a bottom plan view of the opening center of this invention.

With reference to FIGS. 4, 5 and 6, other features of the appliance 10 of this invention optionally include a conventional flange-type bottle opener 36 attached to the housing 16 below the can opener assembly 18 by two screws 37. The bottle opener 36 is located within a recess 38 at the center of the lower front portion of the housing 16. In addition, a hone or honing stone 40 is trapped in a pocket 41 formed along one side of the housing 16 by mating portions of the two housing portions 20 and 22. Because the bottle opener 36 and the hone 40 are both optional features and may be entirely conventional, they are not further described herein.

Figure 3:
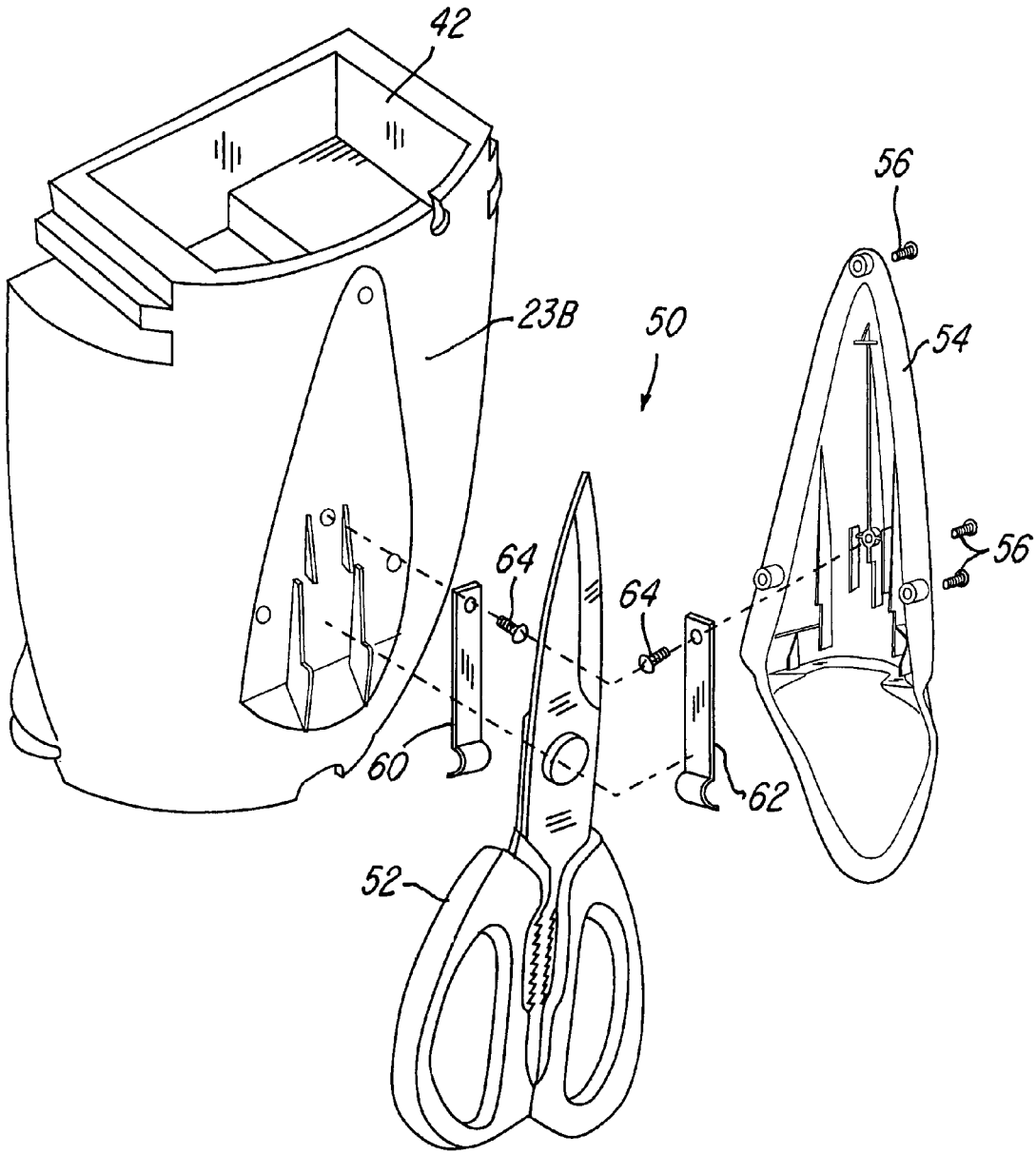
FIG. 3 is a fragmentary, exploded view of the housing and a cover member for a sheath for holding a scissors in accordance with this invention, a clamp used to hold the scissors partly in the sheath, and a scissors which may be inserted in the sheath.

Referring to FIGS. 3 and 6, in accordance with this invention, the appliance is provided with a downwardly-open, vertically-extending, scissors-receiving sheath, generally designated 50, for a scissors, such as the illustrated scissors 52. The sheath 50 is formed by the rear wall 23B of the housing 16 and a cover member 54 connected to the rear wall 23 by screws 56. A scissors holder or clamp 58 comprising a pair of cooperating spring metal clamp members 60 and 62, mounted by screws 64 respectively on the housing rear wall 23B and the cover member 54, releasably retain the scissors 52 within the sheath 50 when the scissors 52 are inserted upwardly from below the appliance 10.

Further in accordance with this invention, with reference to FIGS. 5 and 6, a jar opener, generally designated 70 is mounted on the bottom wall 23D of the housing 16. The jar opener 70 includes a pair of elongate stainless steel plates 74 and 76 which extend at an acute angle outwardly from the rear to the front of the bottom wall 23D. The plates 74 and 76 are clamped to respective support pads 78 and 80 formed on the housing bottom wall 23D, by respective clamp plates 82 and 84. The steel plate 76 has a series of saw teeth 86 along its exposed edge for gripping the edge of a jar lid. As evident, and as indicated by phantom lines in FIG. 6, a jar (not shown) with a lid 90, may be pressed upwardly against the housing bottom wall 23D and rearwardly into firm engagement with the stainless steel strips 76 and 78 and then rotated to loosen the lid 90.

Although the presently preferred embodiment of this invention has been described, it will be understood that within the purview of the invention various changes may be made within the scope of the following claims.

We claim:

1. A household opening appliance comprising an electric can opener having a housing, a jar opener mounted on a bottom wall of said housing, and a sheath for a scissors, said sheath being formed by a back wall of said housing and a cover member connected to said back wall.

2. The appliance of claim 1 further comprising a scissors holder within said sheath, said scissors holder comprising a clamp formed from a first clamp member mounted on said back wall and a second clamp member mounted on said cover member.

3. A household opening appliance comprising an electric can opener having a housing and a sheath for a scissors on a back of said housing, said sheath being formed by a back wall of said housing and a cover member connected to said back wall.

4. The appliance of claim 3 further comprising a scissors holder within said sheath, said scissors holder comprising a clamp formed from a first clamp member mounted on said back wall and a second clamp member mounted on said cover member.

5. The household opening appliance of claim 3 further comprising a scissors holder within said sheath, said scissors holder comprising a pair of cooperating clamp members for releasably retaining a scissors within said sheath.

6. The household opening appliance of claim 3 further comprising a scissors holder within said sheath, said scissors holder comprising a pair of cooperating spring metal clamp members for releasably retaining a scissors within said sheath.

* * * * *